US007604579B2

(12) United States Patent
Isacowitz et al.

(10) Patent No.: US 7,604,579 B2
(45) Date of Patent: Oct. 20, 2009

(54) STEP BARREL/CHAIR EXERCISE APPARATUS

(75) Inventors: Rael Isacowitz, Hood River, OR (US); Ken Endelman, Sacramento, CA (US); Brian Janowski, Marquette, MI (US)

(73) Assignee: Balanced Body, Inc., Sacramento, CA (US)

( * ) Notice: Subject to any disclaimer, the term of this patent is extended or adjusted under 35 U.S.C. 154(b) by 381 days.

(21) Appl. No.: 11/758,546

(22) Filed: Jun. 5, 2007

(65) Prior Publication Data

US 2008/0015096 A1 Jan. 17, 2008

Related U.S. Application Data

(60) Provisional application No. 60/807,045, filed on Jul. 11, 2006.

(51) Int. Cl.
*A63B 21/04* (2006.01)

(52) U.S. Cl. ..... 482/130; 482/92; 482/129

(58) Field of Classification Search ..... 482/92, 482/121–130, 148
See application file for complete search history.

(56) References Cited

U.S. PATENT DOCUMENTS 5,346,444 A 9/1994 Hsieh
6,705,975 B2 3/2004 Kuo
7,104,937 B2 * 9/2006 Arbuckle et al. ..... 482/142
7,452,313 B2 * 11/2008 Endelman ..... 482/140
7,503,882 B2 * 3/2009 Sechrest et al. ..... 482/103

OTHER PUBLICATIONS

International Search Report and Written Opinion from the corresponding International Application No. PCT/US2007/073237.

* cited by examiner

*Primary Examiner*—Glenn Richman
(74) *Attorney, Agent, or Firm*—Greenberg Traurig, LLP

(57) ABSTRACT

A Pilates step barrel/chair exercise apparatus has side walls and a unique elastic resistance member anchor structure fastened to each of the side walls. Each anchor structure has an anchor socket assembly fastened to one of the side walls and a removable elastic member anchor bar assembly mounted in the anchor socket assembly. The anchor socket assembly has a central tubular portion passing through the one of the side walls and a flange portion fastening the tubular portion to the side wall. The anchor bar assembly has an L shaped anchor bar, a cylindrical yoke receiving and holding a long leg of the anchor bar, and a spring bar tube rotatably fastened to a short leg of the anchor bar. The cylindrical yoke has a portion adapted to fit within a central bore of the tubular portion of the anchor socket assembly, and has a plurality of spaced radial holes therearound for engaging with and retain the anchor bar assembly in the anchor socket assembly.

16 Claims, 4 Drawing Sheets

STEP BARREL/CHAIR EXERCISE APPARATUS

CROSS REFERENCE TO RELATED APPLICATIONS

This application claims the benefit of priority of U.S. Provisional Patent Application No. 60/807,045, entitled EXERCISE APPARATUS, filed Jul. 11, 2006.

BACKGROUND

1. Field of the Disclosure

This application relates generally to exercise apparatus and more particularly to a seated apparatus that incorporates adjustable location resistance member anchors.

2. Description of Related Art

Exercise equipment commonly known as Pilates exercise equipment includes various forms of apparatus originally developed by Joseph Pilates. One of those devices is called a "Chair" and another is a "step barrel". Each is basically support for a user to sit or lie against while performing particular physical exercises requiring particular movement sequences involving arms, legs and torso. These devices are static supports. The physical exercises that a user can perform are limited to simple movements utilizing their own body weight as resistance. There is therefore a need for a seated apparatus that permits a user to perform advanced and enhanced Pilates exercises with additional resistance.

SUMMARY

A modified Pilates chair and step barrel is modified to include unique anchor assemblies to which elongated elastic members may be attached for performing resistance exercises in conjunction with exercise regimens formerly only available without the added dimension of resistance.

A step barrel/chair exercise apparatus in accordance with this disclosure has a support structure adapted to stand on a floor. The support structure may be in the shape of a barrel, a step barrel, a chair, or a combination of such shapes. The support structure, in each case, has a pair of spaced apart vertical side walls, and has an elastic resistance member anchor structure in accordance with this disclosure fastened to each of the side walls. Each of the anchor structures includes an anchor socket assembly fastened to one of the side walls and a removable elastic member anchor bar assembly mounted in the anchor socket assembly.

The anchor socket assembly has a central tubular portion passing through the one of the side walls and a flange portion fastening the tubular portion to the side wall. The tubular portion has a central axial through bore and a threaded radial bore extending into the central through bore. The radial bore receives and carries a spring loaded retractable plunger therein.

The anchor bar assembly has an L shaped anchor bar, a cylindrical yoke receiving and holding a long leg of the anchor bar, and a spring bar tube rotatably fastened to a short leg of the anchor bar. The cylindrical yoke has a portion adapted to fit within the central bore of the tubular portion of the anchor socket assembly. The cylindrical yoke has a plurality of spaced radial holes around it for engaging the retractable plunger in one of the holes to retain the anchor bar assembly in the anchor socket assembly.

These and other features advantages and objects of the disclosure will become more apparent from a reading of the Detailed Description taken in conjunction with the various figures of the drawing.

DETAILED DESCRIPTION

Figure 1:
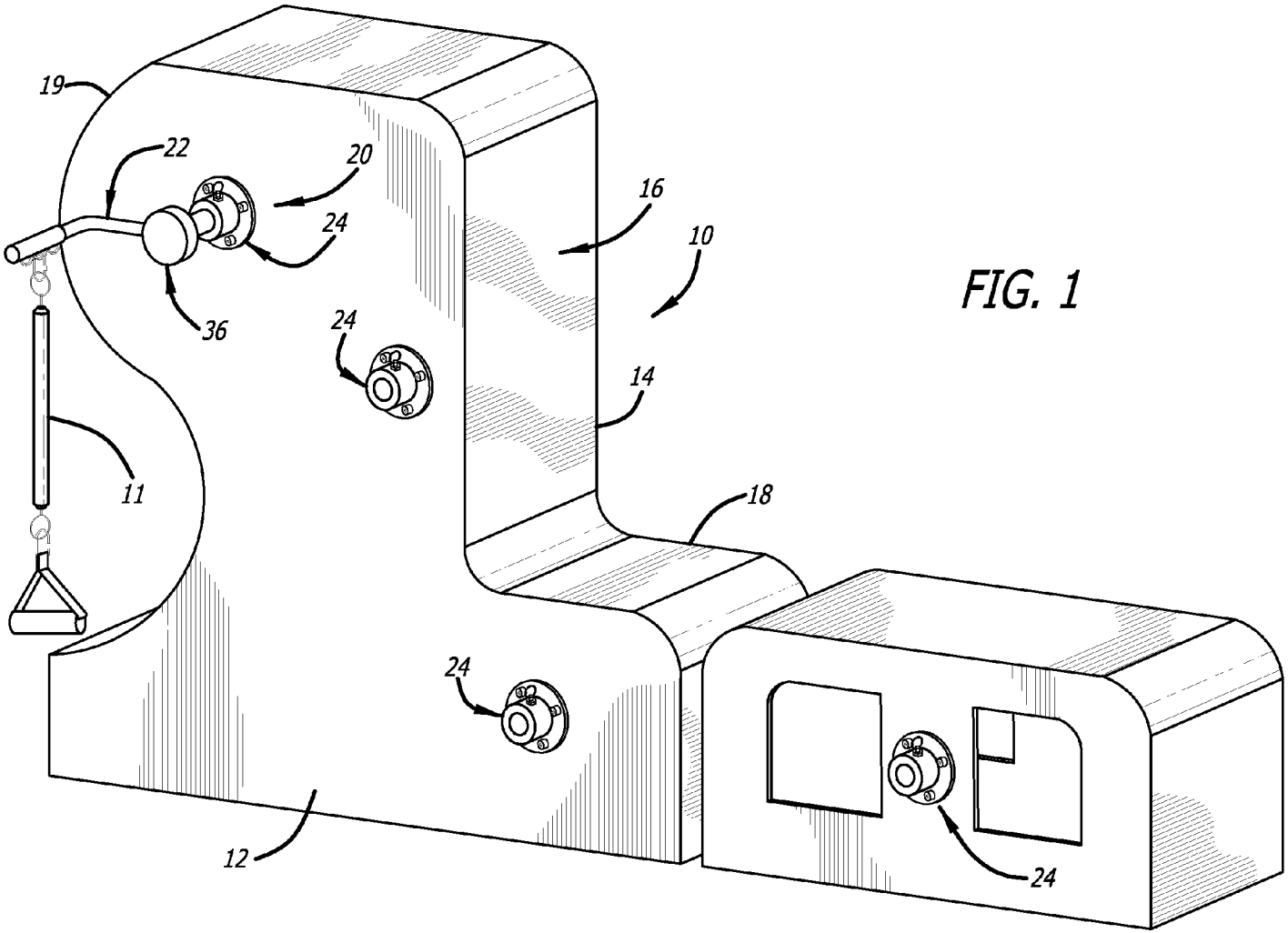
FIG. 1 is a perspective view of a first embodiment of an exercise apparatus in accordance with the present disclosure.

A first embodiment of the exercise apparatus 10 is shown in FIG. 1. The apparatus 10 comprises two vertical spaced apart sides 12 and 14 forming a support structure 16 therebetween having a padded seat portion 18 and a curved back support portion 19 opposing the seat portion. The entire apparatus 10 is designed to solidly rest on a horizontal surface such as a floor.

The opposite sides of the structure are vertical panels 12 and 14 to which are attached unique elastic member anchor structures 20 in accordance with the present disclosure. These anchor structures 20 each include a spring anchor bar assembly 22 and an anchor socket assembly 24. Each spring anchor bar assembly 22 fits within an anchor socket assembly 24 that is fastened to the side plate or panel 12 or 14 of the exercise apparatus 10. In FIG. 1, three separate spaced anchor socket assemblies 24 are shown. Similarly, although not shown in FIG. 1, there are an additional three socket assemblies 24 similarly positioned on the opposite side of the apparatus 10. The locations of the structures 20 on the panels 12 and 14 may be other than as shown in FIG. 1, as these positions are merely exemplary.

Figure 5:
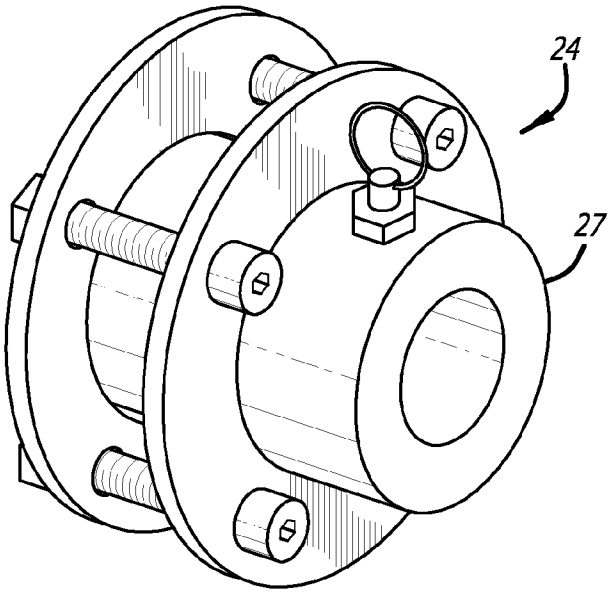
FIG. 5 is a separate perspective view of the spring anchor bar socket assembly in accordance with the present disclosure.
Figure 6:
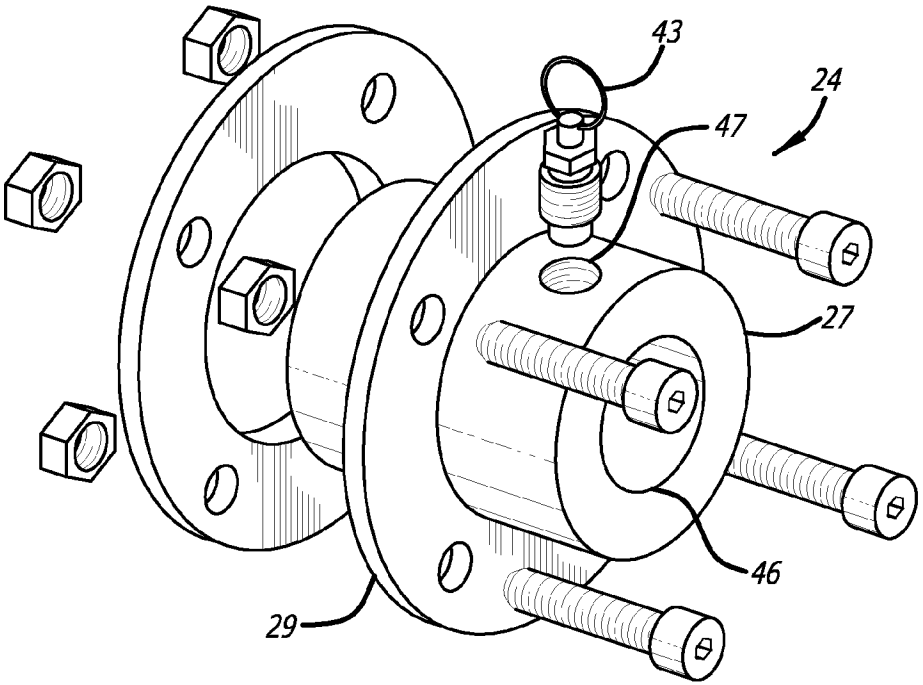
FIG. 6 is an exploded perspective view of the socket assembly shown in FIG. 5.

Each socket assembly 24 comprises a socket member 41 as shown in FIGS. 5 and 6 that has a tubular portion 27 and a central flange portion 29. The flange portion 29 forms a ring around the tubular portion 27. The tubular portion 27 has a central bore 46 therethrough and a threaded radial bore 47. The flange 29 has a plurality of equally spaced holes therethrough receiving socket head screws 44. An annular backing plate 42 has a complimentary set of holes therethrough receiving the free ends of the socket head screws 44 as shown in FIG. 5.

Figure 2:
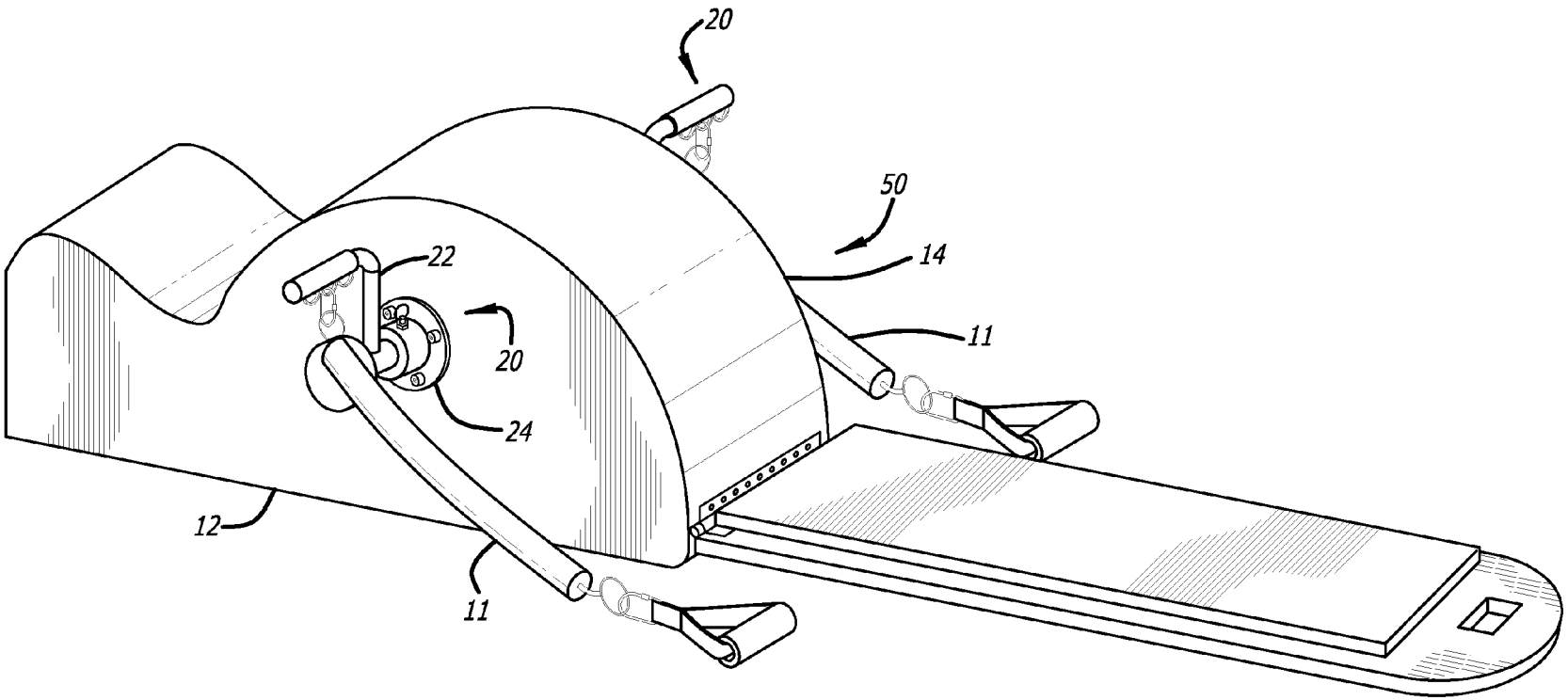
FIG. 2 is a perspective view of a second embodiment of an exercise apparatus in accordance with the present disclosure.
Figure 4:
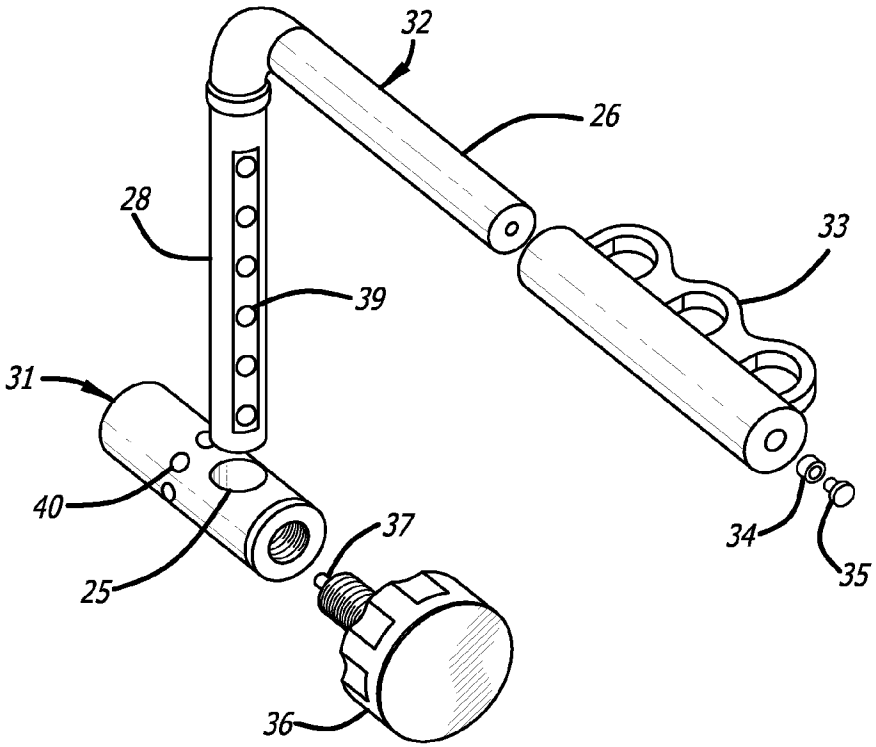
FIG. 4 is an exploded view of the spring anchor bar assembly shown in FIG. 3.
Figure 3:
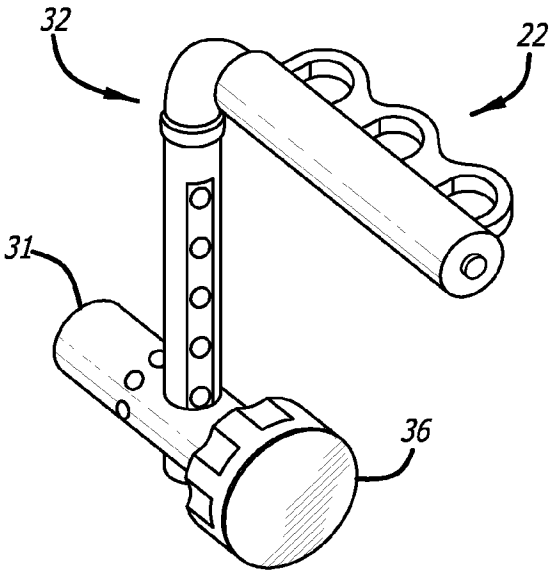
FIG. 3 is a separate perspective view of the spring anchor bar assembly in accordance with the present disclosure that is used in the embodiments shown in FIGS. 1 and 2.

As shown in FIGS. 1 and 2, each of the side panels 12 and 14 has three holes through which a socket assembly 24 is fastened to the side panel 12 or 14 of the apparatus 10. The spring anchor bar assembly 22 is separately shown in FIG. 3. The anchor bar assembly 22 is adjustably secured in the socket assembly 24 as is shown in FIGS. 1 and 2. The spring anchor bar assembly 22 may be removed from socket assembly 24 and repositioned in a different socket assembly 24 as the user may desire, simply by lifting the spring plunger 43 from the threaded bore 47 and sliding out the spring bar yoke 31 from the bore 46 in the socket assembly 24.

The spring anchor bar assembly 22 comprises an "L" shaped solid spring bar arm 32, a spring bar tube 33 slidably disposed on the short leg 26 of the spring bar arm 32 and a spring bar yoke 31 which removably fits within the central bore 46 through the socket assembly 24. The spring bar yoke 31 has a plurality of radial holes 40 therethrough. Preferably there are 8 radial holes 40 so that the anchor bar assembly may be positioned at eight different 45 degree positions around the socket assembly 24. When the spring bar yoke 31 is inserted into the central bore 46 in the socket assembly 24 the plunger cap or hand retractable plunger 43 engages into one of the holes 40 to position the yoke 31 at any one of the eight radial positions on the yoke 31 corresponding to registry of the plunger 43 with one of the holes 40 in the yoke 31. The hand retractable plunger 43 is a spring loaded pin that has its outer sleeve threadably inserted into the radial bore 47 through one side of the socket 41.

The spring anchor bar arm 32 is an L-shaped member having a smooth cylindrical portion on the short leg 26 and a series of axially spaced holes or detents 39 in the long portion 29. The long portion 29 is inserted through the transverse bore 25 in the spring bar yoke 31. A threaded release pin knob 36 has a spring loaded ball pin end 37 that threadably fits within the end of the spring anchor bar yoke 31. The release type pop pin knob 36 is threaded into the yoke 31 such that the pin end 37 engages with one of the detents or holes 39 in the long portion 28 of the spring anchor bar arm 32. When the knob 36 is tightened, the pin end 37 securely fastens the long leg 28 of the L-shaped spring bar arm 32 at one of the axially spaced detent positions 39 formed in the long leg 28 of the arm 32.

The spring anchor bar tube 33 has a series of anchor clip spots or eyelets 38 formed along its length. This tube 33 is slidably disposed on the short leg 26 of the spring bar arm 32. The spring bar tube 33 is secured to the spring bar arm 32 via cap screw 35 and washer 34 so that the spring bar tube 33 is free to rotate about the spring bar arm 32. Thus a spring hooked or otherwise fastened to any one of the eyelets 38 may be rotated about the anchor 20 without binding.

As can best be seen in FIG. 1, the elongated elastic member, in this case a coiled spring 11, may be hooked to any one of the eyelets 38 on the spring bar tube so as to position the anchor point of the elastic member 11 at any of a variety of positions spaced from and around the socket assembly 24 on the apparatus 10.

This allows a user to sit on the chair portion 18, grasp the free end of the elastic member 11, and perform various exercises utilizing resistance provided by the elastic member with the spring anchor bar assembly 22 located in either an upper, a mid, or a lower socket assembly 24 in order to exercise different muscle groups. Alternatively, a user may stand facing toward or away from the curved back portion 19 of the apparatus 10 and perform different exercises with elastic resistance members 11 such as springs anchored at almost an infinitely variable number of positions on the apparatus 10 afforded by the various locations of the socket assemblies 24.

Another embodiment of the exercise apparatus in accordance with this invention is shown in FIG. 2. Here this is a differently modified Pilates step barrel 50 to which in which spring anchor bar structures 20, as in FIG. 1, are attached, one on each side of the barrel 50. This permits a user to either sit on the barrel portion or sit on the extendable platform portion and perform various exercises with the added resistance afforded by elastic members 11 attached to the anchor bar structures 20 as described above with reference to FIGS. 1, and 3-6.

While the apparatus has been described in terms of what are presently considered to be the most practical and preferred embodiments, it is to be understood that the disclosure need not be limited to the disclosed embodiments. For example, an alternative means for retaining the cylindrical yoke 31 in the central bore 46 may be other than a spring loaded pin 43. Any structure that releasably prevents the cylindrical yoke 31 from rotating may be utilized to perform this function. Such an alternative embodiment may include an internal wedging device within the yoke 31 that engages a portion of the tubular portion 27 to prevent yoke rotation. It is therefore intended to cover all such various modifications and similar arrangements included within the spirit and scope of the claims, the scope of which should be accorded the broadest interpretation so as to encompass all such modifications and similar structures. The present disclosure includes any and all embodiments as defined by the following claims.

What is claimed is:

1. A step barrel/chair exercise apparatus having a support structure adapted to stand on a floor, the support structure having a pair of spaced apart vertical side walls, and an elastic resistance member anchor structure fastened to each of the side walls, wherein each anchor structure comprises:

an anchor socket assembly fastened to one of the side walls and a removable elastic member anchor bar assembly mounted in the anchor socket assembly;

the anchor socket assembly having a central tubular portion passing through the one of the side walls and a flange portion fastening the tubular portion to the side wall, the tubular portion having a central axial bore therethrough and a threaded radial bore extending into the central bore, the radial bore receiving a retractable plunger therein;

the anchor bar assembly having an L shaped anchor bar, a cylindrical yoke receiving and holding a long leg of the anchor bar, and a spring bar tube rotatably fastened to a short leg of the anchor bar, wherein the cylindrical yoke has a portion adapted to fit within the central bore of the tubular portion of the anchor socket assembly, and wherein the cylindrical yoke has a plurality of spaced radial holes therearound for engaging the retractable plunger in one of the holes to retain the anchor bar assembly in the anchor socket assembly.

2. The apparatus of claim 1 wherein the yoke has a cross bore receiving the long leg of the anchor bar and an adjustable knob threaded into one end of the yoke to engage and hold the long leg in the cross bore.

3. The apparatus of claim 2 where the adjustable knob includes a central spring loaded ball pin engaging one of a plurality of holes in the long leg of the anchor bar to hold the anchor bar in position.

4. The apparatus of claim 1 wherein the spring bar tube is a sleeve rotatably fastened to the short leg of the anchor bar.

5. The apparatus of claim 4 wherein the spring bar tube has a plurality of eyelets axially spaced along its length for attaching to one end of an elastic resistance member.

6. The apparatus of claim 1 wherein the yoke has eight equally spaced radial holes around its circumference for receiving the pull pin therein permitting the anchor bar to be positioned in 45 degree increments around the socket assembly.

7. The apparatus of claim 1 wherein each side wall has at least two separate socket assemblies mounted thereon.

8. The apparatus of claim 1 wherein the tubular bar has three spaced eyelets for attachment of a coil spring elastic member thereto.

9. An anchor structure for attaching one end of an elastic resistance member to an exercise apparatus having a support structure adapted to stand on a surface, the support structure having one or more walls, the anchor structure comprising:

an anchor socket assembly fastened to the wall and a removable elastic member anchor bar assembly mounted in the anchor socket assembly;

the anchor socket assembly having a central tubular portion passing through the one of the side walls and a flange portion fastening the tubular portion to the wall, the tubular portion having a central axial bore therethrough and a threaded radial bore extending into the central bore, the radial bore receiving a retractable plunger therein;

the anchor bar assembly having an L shaped anchor bar, a cylindrical yoke receiving and holding a long leg of the anchor bar, and a spring bar tube rotatably fastened to a short leg of the anchor bar, wherein the cylindrical yoke has a portion adapted to fit within the central bore of the tubular portion of the anchor socket assembly, and wherein the cylindrical yoke has a plurality of spaced radial holes therearound for engaging the retractable plunger in one of the holes to retain the anchor bar assembly in the anchor socket assembly.

10. The anchor structure of claim 9 wherein the yoke has a cross bore receiving the long leg of the anchor bar and an adjustable knob threaded into one end of the yoke to engage and hold the long leg in the cross bore.

11. The anchor structure of claim 10 where the adjustable knob includes a central spring loaded ball pin engaging one of a plurality of holes in the long leg of the anchor bar to hold the anchor bar in position.

12. The anchor structure of claim 1 wherein the spring bar tube is a sleeve rotatably fastened to the short leg of the anchor bar.

13. The anchor structure of claim 12 wherein the spring bar tube has a plurality of eyelets axially spaced along its length for attaching to one end of an elastic resistance member.

14. The anchor structure of claim 9 wherein the yoke has eight equally spaced radial holes around its circumference for receiving the pull pin therein permitting the anchor bar to be positioned in 45 degree increments around the socket assembly.

15. The anchor structure of claim 9 wherein each side wall has at least two separate socket assemblies mounted thereon.

16. The anchor structure of claim 9 wherein the tubular bar has three spaced eyelets for attachment of a coil spring elastic member thereto.

* * * * *